United States Patent [19]

Komatsu et al.

[11] 4,388,621

[45] Jun. 14, 1983

[54] DRIVE CIRCUIT FOR CHARACTER AND GRAPHIC DISPLAY DEVICE

[75] Inventors: Shigeru Komatsu; Shigeru Hirahata; Tsuguji Tachiuchi, all of Yokohama, Japan

[73] Assignee: Hitachi, Ltd., Tokyo, Japan

[21] Appl. No.: 158,263

[22] Filed: Jun. 10, 1980

[30] Foreign Application Priority Data

Jun. 13, 1979 [JP] Japan ..... 54-73558

[51] Int. Cl.[3] ..... G09G 1/00

[52] U.S. Cl. ..... 340/802; 340/798; 340/750

[58] Field of Search ..... G09G/3/00; 340/703, 340/750, 748, 811, 802, 798, 814

[56] References Cited

U.S. PATENT DOCUMENTS 3,585,677 6/1971 Christopher ..... 340/750

3,771,155 11/1973 Hayashi et al. ..... 340/703

*Primary Examiner*—Marshall M. Curtis

*Attorney, Agent, or Firm*—Antonelli, Terry & Wands

[57] ABSTRACT

In a $\phi_2$ cycle steal mode, a clock signal is selected such that a time period during which a RAM is connected to a timing signal generator for display is extended and a time period during which the RAM is connected to a CPU is shortened accordingly, without changing an overall period. This clock signal is used to actuate a switching circuit for the RAM while a clock signal having unmodified duty ratio is applied to the CPU, a ROM and external circuits so that a display data readout period from the RAM is extended without affecting the CPU clock frequency and the operation of other circuits. During this readout period, a plurality of display address signals are applied to the RAM from the timing signal generator and a plurality of data derived from the RAM are sequentially loaded in a register which is then read out at a desired timing to enable the display of a plurality of characters in one CPU clock period.

3 Claims, 5 Drawing Figures

DRIVE CIRCUIT FOR CHARACTER AND GRAPHIC DISPLAY DEVICE

BACKGROUND OF THE INVENTION

1. Field of the invention

The present invention relates to a character and graphic display device for displaying information received from a central processing unit, and more particularly it relates to a drive circuit for a character and graphic display device wherein a data memory of the central processing unit (CPU) and a display memory of the display device are common, that is, the display memory is located in a memory space of the CPU.

2. Description of the Prior Art

In recent years, as the semiconductor technology has been developed, small scale computers including programmable arithmetic unit LSI's, called microcomputers, have been marketed with a relatively inexpensive price. Those computers usually have keyboards as input devices and CRT display devices as output devices. In order to achieve a low price, various improvements have been made to memory units and the display devices serving as the output devices, which are apt to be expensive.

Home television receiver sets or those one with portions thereof (e.g. tuners) being eliminated may be used as the CRT display devices. Those CRT devices, however, have a low CRT afterglow property and have no memory function by themselves. Accordingly, a display memory for storing all of the codes of characters and/or graphic patterns to be displayed on a display screen is necessary. The CPU controls the data transfer to the display memory. The display memory is usually located in one of the following two ways;

In one way, the whole unit including the display memory is considered as an I/O device, and in the other way the display memory is located in the computer and addressed in the same manner as the data memory is addressed. The latter has been frequently used in the microcomputer system because of simplicity of read/write operation to the display memory. This technique is shown, for example, in the Japanese periodical "Transistor Gijutsu" May 1977, pages 215–217 and implemented in the commercially available Hitachi microcomputer MB 6880 L2.

FIG. 1 is a block diagram showing an example of a circuit construction of a prior art character and graphic display device. It comprises a memory (ROM) 2 for storing a computer system program, a memory (RAM) 6 for temporarily storing data when the system operates, a display drive circuit 7 for generating signals to display characters and/or graphic patterns on a CRT display device, not shown, a CPU 1 for controlling the units described above and processing data, a clock signal generator 4 for generating clock signals to be supplied to the CPU 1 based on basic clock signals from an oscillator 3, a timing signal generator 8 for generating timing signals for displaying characters and/or graphic patterns, and a switching circuit 5 for alternately switching the timing signals for the timing signal generator 8 and addressing signals for addressing data from the CPU 1 to the RAM 6 to selectively supply those signals to the RAM 6. Numeral 9 denotes a data bus, numeral 10 denotes an address bus, numeral 11 denotes a timing signal path and numeral 12 denotes a video signal output terminal which leads to the CRT display device (which is usually a separate box from a box including the CPU).

The system shown in FIG. 1 is a character and graphic display device which utilizes a display mode called $\phi_2$ cycle steal display mode which enables continuous display of characters and/or graphic patterns on the display screen of the display device. This mode is also referred to as a cycle-steal-mode DMA (Direct Memory Access) or a transparent memory system.

As shown in FIG. 2, in the $\phi_2$ cycle steal display mode, the operation of the CPU 1 is based on the fact that the address signal (FIG. 2(*c*)) is issued $T_1$ time period later than the leading edge of $\phi_2$ clock signal (FIG. 2(*a*)) and data signal (FIG. 2(*d*)) is accessed at the trailing edge of $\phi_2$ clock signal (FIG. 2(*b*)). During the absence of the $\phi_2$ clock signal b, that is, in the time period $T_2$, the RAM 6 is disconnected from the address bus 10 of the CPU 1 and the display address signal is transmitted through the timing signal path 11 from the timing signal generator 8 to receive data from the RAM 6 for displaying the characters and/or graphic patterns.

The operation of the circuit of FIG. 1 is now explained for an example where characters are displayed on the display device, not shown, in accordance with a program stored in the ROM 2.

The CPU 1 fetches character data to be displayed in an internal register of the CPU 1 in accordance with the program stored in the ROM 2 which is addressed by the addressing signals. The CPU 1 then produces an address signal for a display area of the RAM 6 which corresponds to a character display position on the display device, and the prefetched character data signal. The switching circuit 5 is switched by the $\phi_2$ clock signal b so that the CPU 1 and the RAM 6 are connected together during a time period $T_3$ of the $\phi_2$ clock signal, as shown in FIG. 2. Thus, the CPU 1 writes the character data signal into the RAM 6 during the time period $T_3$. In this manner, the character data signals are sequentially written into the RAM 6 during the time period $T_3$. As shown in FIG. 2, the switching circuit 5 is switched to the position opposite to that shown in FIG. 1, during time period $T_2$ of the $\phi_2$ clock signal so that the timing signal generator 8 is connected to the RAM 6 through the signal path 11. Accordingly, the character data signals stored in the RAM 6 are sequentially read out during the time period $T_2$ by the display address signals from the timing signal generator 8 and they are taken from the video signal output terminal 12 as the character/graphic pattern display signals via the character/graphic pattern display drive circuit 7 and displayed on the CRT display device not shown. In this manner, the switching circuit 5 is switched by the $\phi_2$ clock signal b so that the write operation of character data from the CPU 1 to the RAM 6 and the read operation of the character data from the RAM 6 by the display address signal from the timing signal generator 8 are effected in one character display period $T_4$, as shown in FIG. 2(*e*). The adoption of the $\phi_2$ cycle steal mode provides the following advantages:

(1) The characters can be continuously displayed on the CRT display screen while the CPU continuously reads and writes the RAM which stores the display data. (This RAM may hereinafter be referred to as display RAM.)

(2) Since the display RAM is continuously read during the time period $T_2$ of the $\phi_2$ clock signal shown in FIG. 2 by the display address signal from the character display timing signal generator, a dynamic RAM which is much less expensive than a static RAM may be used without adding a refresh counter.

In this $\phi_2$ cycle steal mode, however, since one-character data read during the time period $T_2$ of the $\phi_2$ clock signal shown in FIG. 2 is displayed for one character display period $T_4$ (FIG. 2(*e*)) or one CPU clock period, the number N of characters that can be displayed horizontally when the clock signals appear at 1 $MH_Z$ which is an upper limit of an operation speed of a conventional CPU (a synchronous bus type microprocessing unit) would be 64 ($N=64\ \mu s/T_4$) assuming that one horizontal scan period for the CRT display is 64$\mu$ seconds. This is the number of characters that can be displayed in one horizontal scan period including blanking periods. Assuming that approximately 70% of it is available for the actual display, the number of characters that can be actually displayed on the display screen is at most 45 ($N=64\times0.7$). This is not sufficient for the display of multiple digits resulting from complex arithmetic operations or the display of tabulation of multiple items for business use.

One of the most conventional methods for increasing the number of characters per line displayed on the display device is to increase the clock frequency for operating the CPU. This method, however, needs a high speed CPU which is more expensive. In addition to the CPU, the RAM 6 also needs to operate at high speed. It is expensive and special. As an example, in order to increase the number of characters displayed per horizontal line to 120, the one character display period $T_4$ is to be equal to 530 ns ($=64\ \mu s/120$ characters). The CPU clock frequency $f_\phi$ when $T_4=530$ ns is 1.88 $MH_Z$ ($=1/T_4$), which requires a high speed CPU operable with 2 $MH_Z$ clock signals. The time period $T_2$ required to read the RAM 6 is approximately equal to $T_4/2$, that is, it is 265 ns ($=530/2$). The time period (cycle time) required to read out conventional dynamic RAM is 320 ns−375 ns, which does not meet the readout time requirement mentioned above. Accordingly, the conventional dynamic RAM cannot be used.

SUMMARY OF THE INVENTION

It is an object of the present invention to provide a drive circuit for a character/graphic pattern display device which allows to increase the number of characters displayed per horizontal line on a display screen of the CRT display device.

In order to achieve the above object, in accordance with the present invention, a time period in which a RAM is connected to a display timing signal generator in a $\phi_2$ cycle steal mode is extended while a time period in which the RAM is connected to a CPU is shortened accordingly so that overall period remains unchanged. In other words, the clock signals having the same clock frequency and different duty ratios are generated, and the clock signals having changed duty ratio are used to drive a switching circuit for the RAM while the clock signals having unchanged duty ratio are applied to the CPU, ROM and external circuit. In this manner, the readout time of the display data from the RAM is extended without effecting the CPU clock frequency and other circuits, and during that readout time a plurality of display address signals are applied to the RAM from the timing signal generator so that a plurality of data read out of the RAM are sequentially fetched to a register, which is then read out at an appropriate timing to display a plurality of characters in one CPU clock period.

DESCRIPTION OF THE PREFERRED EMBODIMENT

Figure 1:
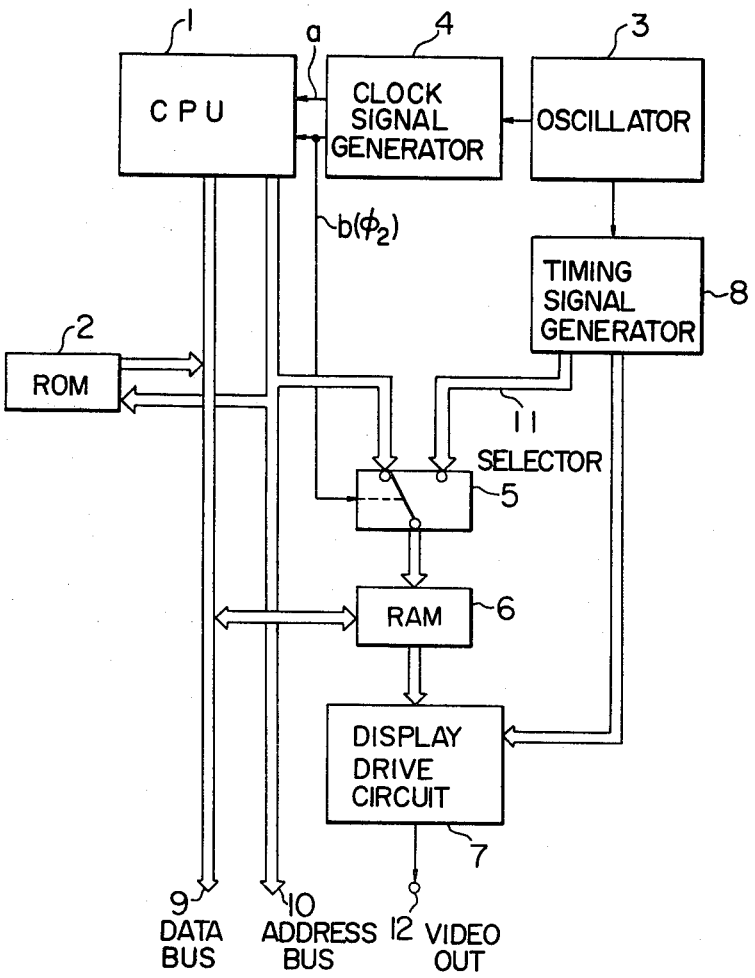
FIG. 1 PRIOR ART
FIG. 1 is a block diagram showing a circuit configuration of a prior art character/graphic pattern display device.
Figure 2:
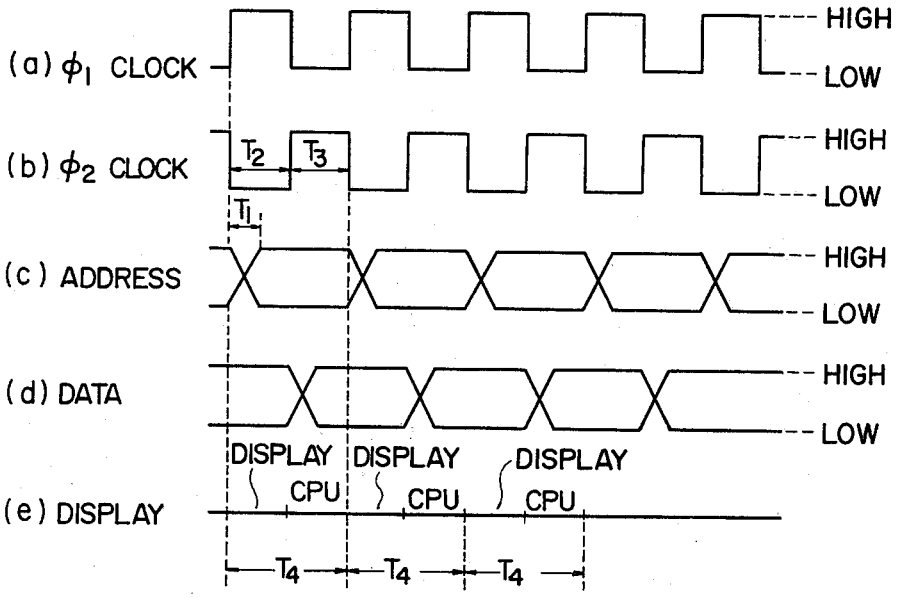
FIG. 2 PRIOR ART
FIG. 2 shows a timing chart of signals for illustrating the operation of the display device shown in FIG. 1.
Figure 3:
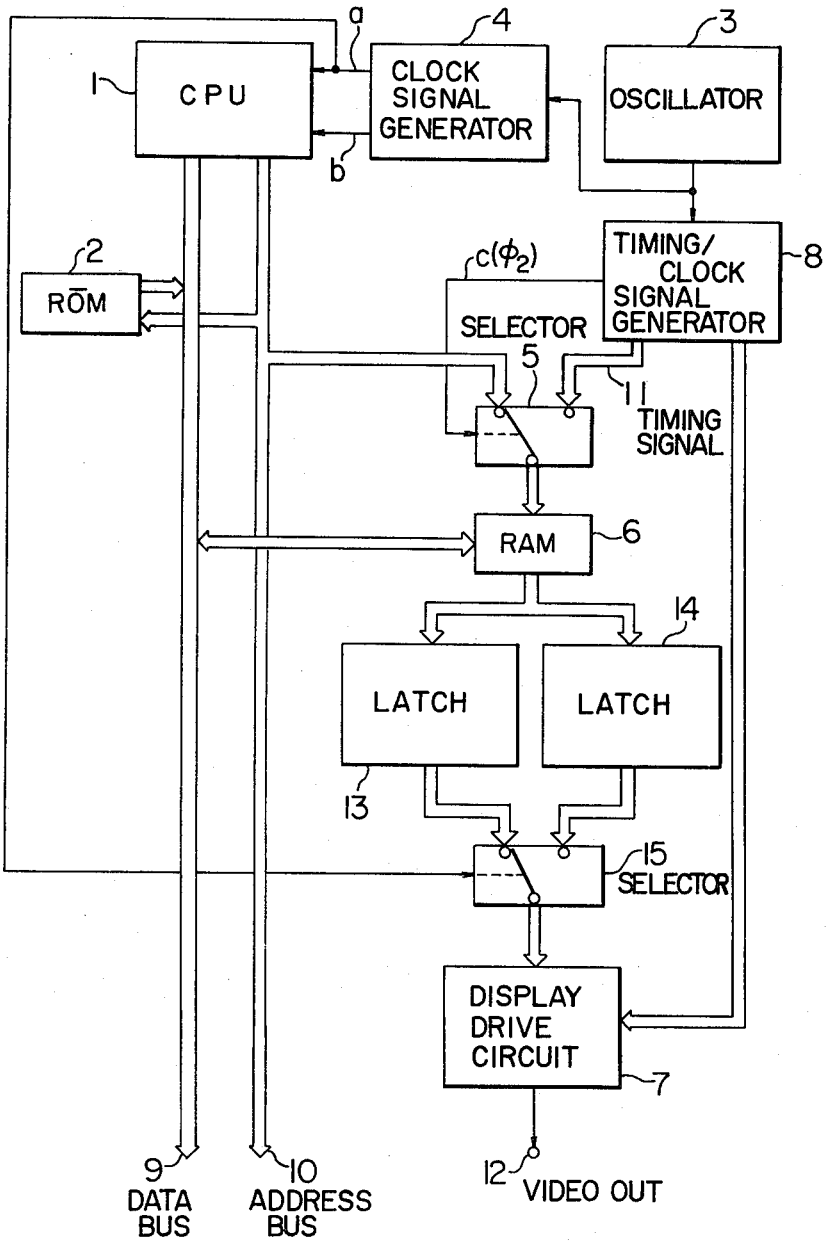
FIG. 3 is a block diagram showing one embodiment of the present invention.

Referring now to the accompanying drawings, the preferred embodiment of the present invention is explained. FIG. 3 is a block diagram of one embodiment of the present invention. In FIG. 3, numeral 8' denotes a timing signal/clock signal generator which is similar to the timing signal generator 8 shown in FIG. 1 except that the former produces display clock signals $\phi_2'$ of modified duty ratio. Numerals 13 and 14 denote latch circuits and numeral 15 denotes a switching circuit. The other numerals denote the equivalent units or circuits to those having the corresponding numerals shown in FIG. 1.

Figure 4:
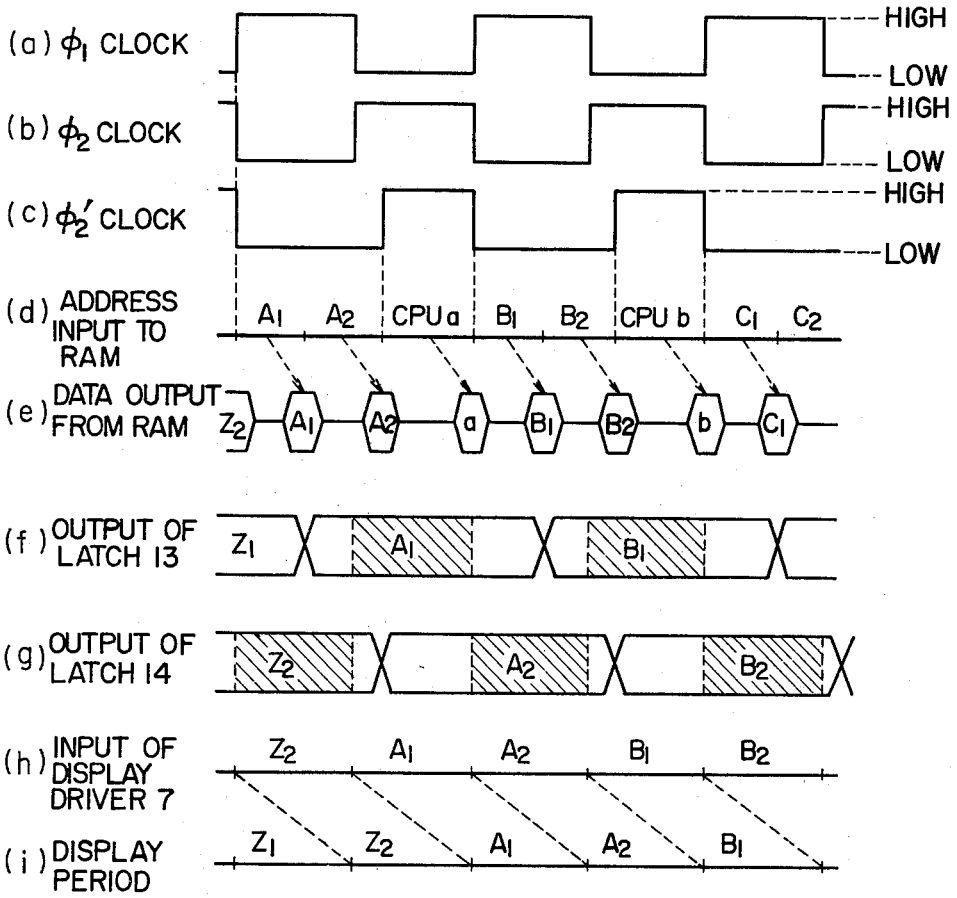
FIG. 4 shows a timing chart of signals for illustrating the operation of the embodiment shown in FIG. 3.

FIG. 4 shows a timing chart of the signals for illustrating the operation of the embodiment of FIG. 3.

Referring to FIGS. 3 and 4, the operation of the embodiment of FIG. 3 is now explained. Based on source oscillation pulses generated by the oscillator 3, the clock signal generator 4 produces the clock signals $\phi_1$ (FIG. 4(*a*)) and $\phi_2$ (FIG. 4(*b*)) for driving the CPU 1. On the other hand, the timing signal/clock signal generator 8' produces a clock signal $\phi_2'$ (FIG. 4(*c*)) which has the equal frequency and rising and falling edges to those of the clock signal $\phi_2$ but has shorter pulse width (high level duration). The switching circuit 5 switches the address signal for accessing data from the CPU 1 and the display address signal from the timing signal/clock signal generator 8' and supplies those to the RAM 6. The switching of the switching circuit 5 is controlled by the clock signal $\phi_2'$. The display address signal from the timing signal/ signal/clock signal generator 8' is applied to the RAM 6 while to clock signal $\phi_2'$ is at low level, and the address signal from the CPU 1 is applied to the RAM 6 while $\phi_2'$ is at high level. Thus, the pulse width (high level duration) of the clock signal $\phi_2'$ needs only be as long as a minimum time period required for the CPU 1 to access the RAM 6 and the remaining period of the clock signal $\phi_2'$ is kept at low level so that the low level duration is made as long as possible. In first half and second half of the low level period, the lowest order bit of the display address signal from the timing signal/clock signal generator 8' is changed from an initial value "0" to "1", which is then applied to the RAM 6. Thus, during each low level period of $\phi_2'$, two successive display address signals (first one being an even number address and second one being an odd number address) are applied to the RAM 6 as shown in FIG. 4(*d*). More particularly, in FIG. 4(*d*), an even number address A1 and an odd number address A2 are applied as the display address signal during the first low level period of $\phi_2'$, an even number address B1 and an odd number address B2 are applied during the next low level period, an even number address C1 and an odd number address C2 are applied during the next low level period, and so on. On the other hand, during high level periods of $\phi_2'$, the data address signal from the CPU 1 is applied to the RAM 6. That is, in FIG. 4(*d*), the data address signal CPUa is applied in the first high level period and the data address signal CPUb is applied in the next high level period. For those address signals applied, the RAM 6 provides data as shown in FIG. 4(*e*). More particularly, for the two display address signals A1 and A2 in the first low level period of $\phi_2'$, the display data A1 and A2 are read out, the for the data address signal CPUa from the CPU 1 in the first high level period, the data a is read out (or written). The display data A1 read from the even number address of the RAM 6 is retained in the latch circuit 13 and the display data A2 read from the odd number address is retained in the latch circuit 14, for one CPU clock period, respectively. FIGS. 4(*f*) and 4(*g*) show the outputs from the latch circuits. As seen from FIG. 4(*f*), the latch circuit 13 provides the data A1 for the first one CPU clock period and the data B1 for the next period. In FIG. 4(*g*), the latch circuit 14 provides the data A2 for the first one CPU clock period and the data B2 for the next period. The outputs from the latch circuits 13 and 14 are applied to the switching circuit 15, which switches those outputs under the control of the clock signal $\phi_1$ (FIG. 4(*a*)) or the clock signal $\phi_2$ (FIG. 4(*b*)). As an example, if the output of the latch circuit 13 is selected when the clock signal $\phi_1$ is at low level and the output of the latch circuit 14 is selected when $\phi_1$, is at high level, the hatched areas shown in FIGS. 4(*f*) and 4(*g*) are alternately supplied to the display drive circuit 7. FIG. 4(*h*) shows the inputs applied to the display drive circuit 7. It is seen that data Z2, A1, A2, B1, B2, . . . are applied in this order to the display drive circuit 7. The display drive circuit 7 transfers the data with a predetermined time delay to the display device such as CRT display, not shown, under the control of the timing signal/clock signal generator 8', to display characters and/or graphic patterns. The display periods for the characters are shown in FIG. 4(*i*).

Referring to FIG. 3, a specific method for reading out two display data from the RAM 6 in each CPU clock period is explained. The RAM used is a most conventional dynamic RAM in which memory cells are arranged in matrix of rows and columns and addressing is effected by separately applying a row address signal and a column address signal.

Figure 5:
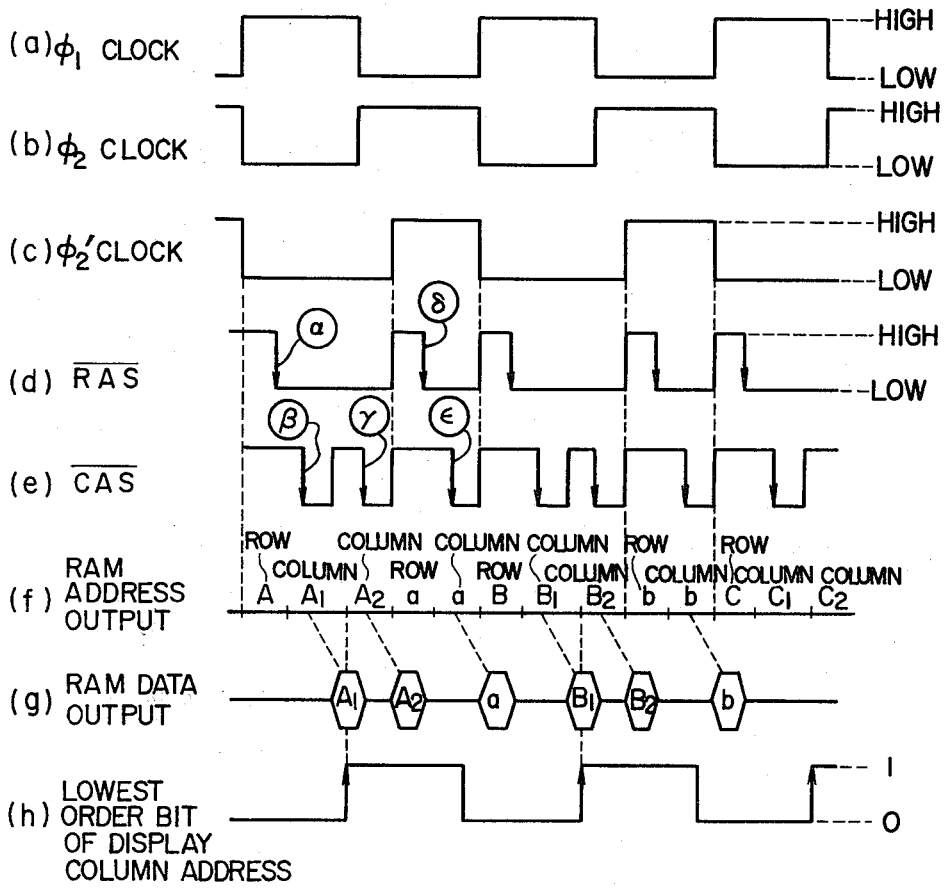
FIG. 5 shows a timing chart of signals for illustrating the readout of display data from a RAM 6 shown in FIG. 3.

Referring to FIG. 5 which shows a timing chart of the signals necessary to explain the readout of the display data from the RAM 6, (*a*) to (*c*) show the same signals as those shown in FIGS. 4(*a*) to 4(*c*). A signal shown in FIG. 5(*d*) serves to strobe the row address signal for the dynamic RAM and it is referred to as $\overline{\text{RAS}}$ (row address strobe). A signal shown in FIG. 5(*e*) serves to strobe the column address signal and it is referred to as $\overline{\text{CAS}}$ (column address strobe). Each of these signals latches the status of the address signal to the RAM (FIG. 5(*f*)) at the trailing edge thereof and provides the data from the RAM 6 a predetermined time after the fetch of the column address signal following to the fetch of the row address signal. Usually, each address is specified by a pair of column address signal and row address signal. In the dynamic RAM, an addressing scheme called paging mode is usually used. This scheme is used when a plurality of data having the same row address and different column addresses are sequentially read or written. Because the row address is common, the row address need be applied only initially. Since the row address signal is maintained during the low level period of the $\overline{\text{RAS}}$ signal (FIG. 5(*d*)), the row address signal need not be applied each time the column address signal is updated. Thus the sequential addressing is effected by applying only the column address signals. As a result, to compare with a conventional method in which the row address signal and the column address signal are always applied in pair to effect addressing, the data readout time from the RAM can be shortened because the time for applying the second and subsequent row addressing signals is saved. In FIG. 5(*f*), assuming that the row address signal status is initially A, it is sensed at the falling edge (α) of the $\overline{\text{RAS}}$ signal (FIG. 5(*d*)). If the column address signal status is A1 (FIG. 5(*f*)), it is sensed at the trailing edge (β) of the $\overline{\text{CAS}}$ signal. This completes the specification of one address and data A1 is read from the RAM 6 (FIG. 5(*g*)). If the column address signal status changes to A2, the column address signal status A2 is sensed at the second trailing edges (γ) of the CAS signal during the low level period of the RAS signal following to the trailing edge α . Since the row address signal status A has been retained, it need not be sensed this time. This completes the specification of the second address. The data A2 is read from RAM 6 (FIG. 5(*g*)). During the high level period of the clock signal $\phi_2'$, the data addressing signal from the CPU 1 is applied to the RAM 6. The row address signal status a is sensed at the falling edge (δ) of the $\overline{\text{RAS}}$ signal and the column address signal status a is sensed at the trailing edge of the CAS signal. After a predetermined time period, the data a is exchanged between the CPU 1 and the RAM 6. The operation follows in a similar manner. The change of the display address signal, e.g. the column address signal from A1 to A2 or from B1 to B2 is attained by controlling the switching timing by the timing signal/clock signal generator 8' such that the lowest order bit of the column address signal is changed from "0" to "1" at an intermediate point between two trailing edges (e.g. (β) and (γ)) of the $\overline{\text{CAS}}$ signal.

As described above, by operating the RAM 6 in paging mode, a plurality of data (two in the preferred embodiment) can be readily read out in one low level period of the clock signal $\phi_2'$.

As described hereinabove, in accordance with the character and graphic display device for computer of the present invention, the number of characters displayed per horizontal line can be increased by the factor of at least two without requiring a high speed CPU or a high speed RAM but using a conventional inexpensive RAM, and with a small scale of additional circuit and without requiring any expensive and special components. When a graphic pattern is to be displayed, the amount of graphic pattern displayed can be increased because a lateral size of each picture element (dot) is decreased by the factor of at least two.

What is claimed is:

1. A drive circuit for a character and graphic display device comprising:

(a) a central processing unit (CPU);

(b) a basic clock pulse generator having an output terminal for providing basic clock pulses;

(c) a CPU clock signal generator having an input terminal connected to said output terminal of said basic clock pulse generator and an output terminal for providing a CPU clock signal in the form required by said CPU, for generating a CPU clock signal based on said clock pulses;

(d) a display timing signal/clock signal generator including a means having an input terminal connected to said output terminal of said basic clock pulse generator and an output terminal for providing a display clock signal, for generating said display clock signal based on said basic clock pulses, said display clock signal having a first period of shorter duration and a second period of longer duration, and means having an output terminal for providing a display timing signal, for generating said display timing signal required by said character and graphic display device based on said basic clock pulses;

(e) a common display/data memory means having an input terminal for receiving an address signal, an input terminal connected to a data bus of said CPU and an output terminal for providing a display data signal corresponding to the address signal, said memory means including a display memory and a data memory in a common area;

(f) a first selecting switch for selectively connecting one of said address bus of said CPU and said output terminal of said timing signal/clock signal generator providing said display timing signal to said input terminal of said memory means; said selecting switch having a control input terminal connected to said output terminal providing said display clock signal and being actuated by said display clock signal to connect said address bus to said input terminal of said memory means during said first period;

(g) a first latch circuit having an output terminal and an input terminal connected to said output terminal of said memory means for latching a display data signal corresponding to an applied even number address signal;

(h) a second latch circuit having an output terminal and an input terminal connected to said output terminal of said memory means for latching a display data signal corresponding to an applied odd number address signal;

(i) a display drive circuit having an input terminal for receiving said display data signal, an input terminal connected to said output terminal of said timing signal/clock signal generator providing said display timing signal and an output terminal for providing a video signal, for producing said video signal in accordance with the applied display data signal and display timing signal; and (j) means including a second selecting switch responsive to a clock signal generated on the basis of said basic clock pulses for alternately connecting said output terminal of said first latch circuit and said output terminal of said second latch circuit to said input terminal of said display drive circuit receiving said display data signal.

2. A drive circuit for a character and graphic display device according to claim 1 wherein said CPU clock signal generator generates two CPU clock signals ($\phi_1$, $\phi_2$) having a phase difference of 180 degrees from each other, said second selecting switch being actuated by said CPU clock signal $\phi_1$.

3. A drive circuit for a character and graphic display device according to claim 1 wherein said CPU clock signal generator generates two CPU clock signals ($\phi_1$, $\phi_2$) having a phase difference of 180 degrees from each other, said second selecting switch being actuated by said CPU clock signal $\phi_2$.

* * * * *